US005142263A

United States Patent [19]

Childers et al.

[11] Patent Number: 5,142,263

[45] Date of Patent: Aug. 25, 1992

[54] SURFACE MOUNT DEVICE WITH OVERVOLTAGE PROTECTION FEATURE

[75] Inventors: Richard K. Childers, Foster City; John H. Bunch, Menlo Park, both of Calif.

[73] Assignee: Electromer Corporation, Belmont, Calif.

[21] Appl. No.: 655,724

[22] Filed: Feb. 13, 1991

[51] Int. Cl.[5] ..... H01C 7/10; H01C 1/14

[52] U.S. Cl. ..... 338/21; 338/322; 338/333

[58] Field of Search ..... 338/20, 21, 315, 322, 338/333

[56] References Cited

U.S. PATENT DOCUMENTS

| | | | |
|---|---|---|---|
| 1,167,163 | 1/1916 | Frank . | |
| 1,483,539 | 2/1924 | Allcutt . | |
| 1,935,810 | 11/1933 | McFarlin | 175/30 |
| 2,409,150 | 10/1946 | Rice | 175/320 |
| 3,486,156 | 12/1979 | Welch | 338/1 |
| 3,685,026 | 8/1972 | Wakabayashi et al . | 340/173 R |
| 3,685,028 | 8/1972 | Wakabayashi et al. | 340/173 R |
| 4,163,204 | 7/1979 | Sado et al . | 338/114 |
| 4,331,948 | 5/1982 | Malinaric et al. | 338/21 |
| 4,347,505 | 8/1982 | Anderson | 340/666 |
| 4,726,991 | 2/1988 | Hyatt et a. | 428/329 |
| 4,795,998 | 1/1989 | Dunbar et al. | 338/5 |

*Primary Examiner*—Marvin M. Lateef

*Attorney, Agent, or Firm*—Flehr, Hohbach, Test, Albritton & Herbert

[57] ABSTRACT

A nonlinear resistive surface mount device for protecting against electrical overvoltage transients which includes a pair of conductive sheets and a quantum mechanical tunneling material disposed between the pair of conductive sheets. This configuration serves to connect the conductive sheets by quantum mechanical tunneling media thereby providing predetermined resistance when the voltage between the conductive sheets exceeds a predetermined voltage.

11 Claims, 4 Drawing Sheets

SURFACE MOUNT DEVICE WITH OVERVOLTAGE PROTECTION FEATURE

BRIEF DESCRIPTION OF THE INVENTION

This invention relates generally to nonlinear resistive transient overvoltage protection devices. More particularly, it relates to electrical surface mount devices with an overvoltage protection feature.

BACKGROUND OF THE INVENTION

All types of conductors are subject to transient voltages which potentially damage associated unprotected electronic and electrical equipment. Transient incoming voltages can result from lightning, electromagnetic pulses, electrostatic discharges, or inductive power surges.

More particularly, transients must be eliminated from electrical circuits and equipment used in radar, avionics, sonar and broadcast. The need for adequate protection is especially acute for defense, law enforcement, fire protection, and other emergency equipment. A present approach to suppressing transients is to use silicon p-n junction devices. The p-n junction devices are mounted on a substrate, commonly a circuit board. They serve as a dielectric insulator until a voltage surge reaches a sufficient value to generate avalanche multiplication. Upon avalanche multiplication, the transient is shunted through the silicon device to a system ground.

Several problems are associated with this prior art solution and other approaches which analogously use Zener diodes, varistors, and gas discharge tubes.

Many of the foregoing circuits and equipment employ components which are mounted on the surface by soldering leads to the conductors of a printed circuit board or conductors in a hybrid circuit. There is a need for a transient protection device which can be surface mounted.

An ideal transient protection device should have the capability of handling high energy with high response time, in the nanosecond or even sub-nanosecond range.

OBJECTS AND SUMMARY OF THE INVENTION

It is a general object of the present invention to provide a transient overvoltage protection surface mount device.

It is a related object of the invention to provide a transient overvoltage protection device which is inexpensive and simple in construction.

It is a further object of the invention is to provide a fast response transient overvoltage protection surface device.

Another object of the invention is to provide an overvoltage protection device capable of handling high energy.

Yet another object of the invention is to provide a transient overvoltage protection surface mount device with a nanosecond response time.

These and other objects are achieved by a surface mount device adapted to be mounted between two surface conductors which includes spaced apart conductive sheets with a quantum mechanical tunneling material placed therebetween. This configuration serves to connect the conductive sheets to one another by quantum mechanical tunneling when the voltage between the conductors and the plate exceeds a predetermined voltage. In one configuration, the sheets are disposed face-to-face and in another configuration, the sheets are side-by-side.

BRIEF DESCRIPTION OF THE DRAWINGS

Other objects and advantages of the invention will become apparent upon reading the following detailed description with reference to the drawings, in which.

DETAILED DESCRIPTION OF THE INVENTION

Figure 1:
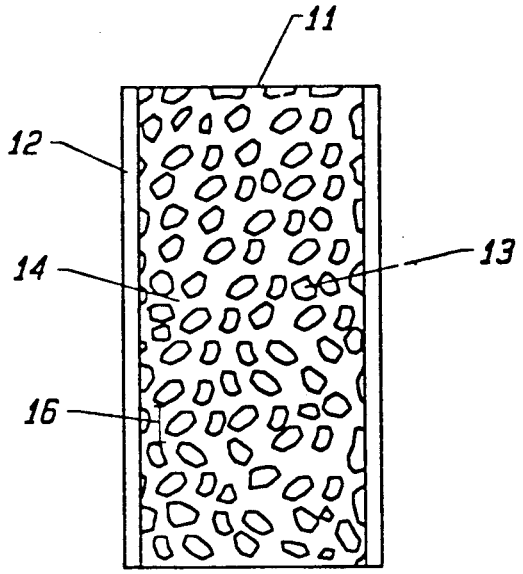
FIG. 1 is an enlarged cross sectional view of a surface mount device subassembly.

Turning now to the drawings, wherein like components are designated by like reference numerals in the various figures, attention is initially directed to FIG. 1. A surface mount device subassembly is depicted therein. Composite material 11 is positioned between the spaced conductive sheets 12. Material 11 includes particles 13 dispersed and supported within binder 14. The on-state resistance of material 11 is determined by the inter-particle spacing 16. Interparticle spacing 16 is selected to be small enough that electron transport through binder 14 separating particles 13 is dominated by quantum mechanical tunneling of electrons in the on-state. In the off-state, the electrical properties of the material 11 is determined by insulating binder 14.

In one embodiment, conductive sheets 12 were copper sheets 5.75 inches wide by 5.75 inches long by approximately 0.002 inches thick. Material 11 was placed between conductive sheets 12. The resultant composite was placed in a large two-platen hydraulic press and compressed to a thickness of 0.030 inches. The pressed composite was then pre-cured in the press at 120 degrees Celsius, 3000 PSI for 15 minutes, then placed in an oven where it was cured at 125 degrees Celsius for four hours. The device subassembly was cut away from the resultant composite sheet.

Figure 2:
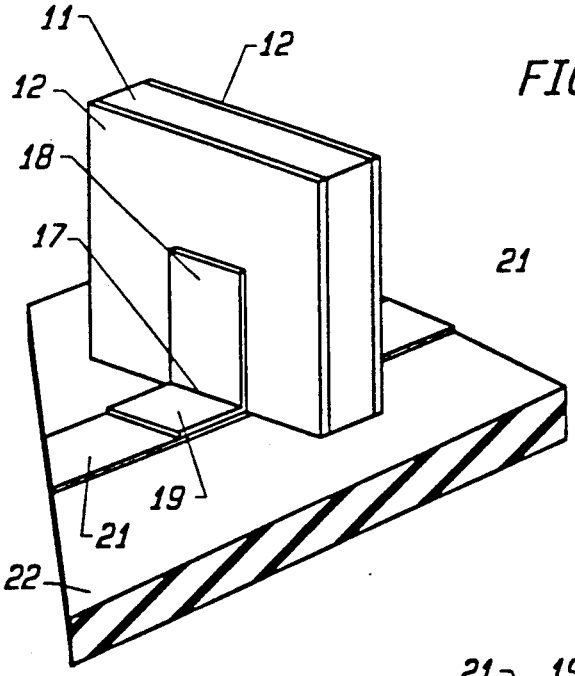
FIG. 2 is a perspective view of the overvoltage protection surface mount device.
Figure 3:
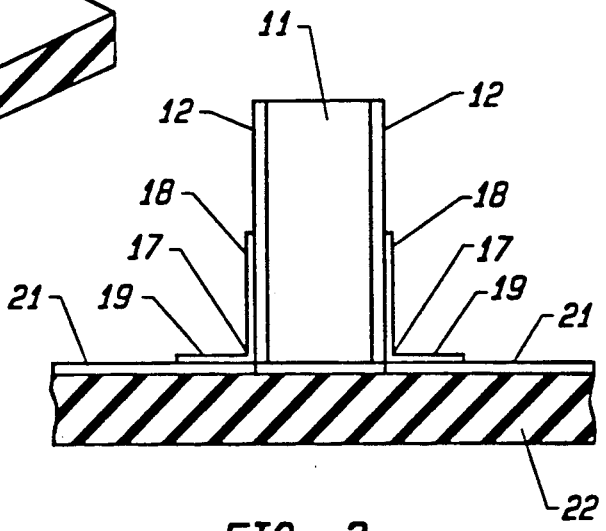
FIG. 3 is a sectional view of the overvoltage protection surface mount device mounted on a printed circuit board or hybrid circuit.

FIGS. 2 and 3 depict an overvoltage protection device incorporating a cut away portion of the subassembly of FIG. 1. Referring to FIG. 3, a surface mount device is shown which has L-shaped conductors or leads 17 having first planar portions 18 connected to corresponding conductive sheets 12 and having second planar portions 19 connected to spaced surface leads 21 carried by an insulating board 22 and serving to interconnect the surface leads 21 when an overvoltage is applied therebetween. One of said leads may be a ground lead.

As the FIG. 3 suggests, the overvoltage protection apparatus of the present invention has a moldable design. As a result of this moldable design, material 11 is readily positioned contiguously between conductive sheets 12. Conductive sheets 12 may be of any shape deemed necessary by the user. The size of the conductive sheets will determine the power handling capabilities.

This moldable design with surface sheets 12 and leads 17 obviates problems in the prior art with mounting discrete elements such as diodes and varistors on a surface conductor. These prior art connections between surface leads 21 and the discrete elements are not as rugged as the unitary moldable design of the present invention.

Figure 4:
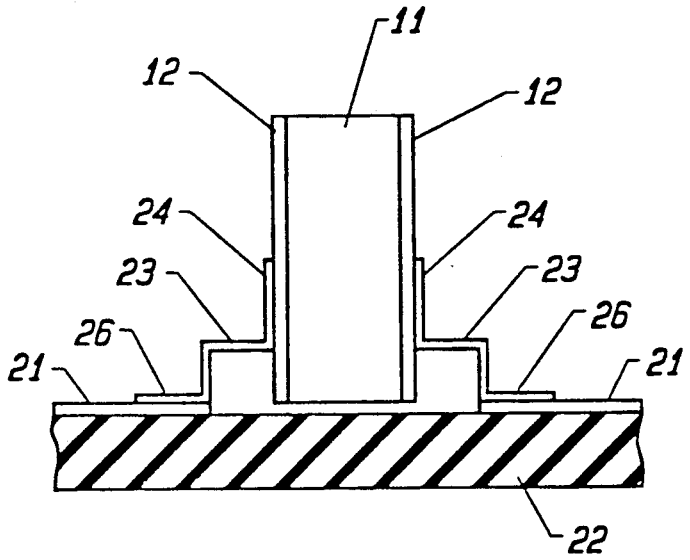
FIG. 4 is a sectional view of the overvoltage protection surface mount device with step configured conductors.

In certain instances, the surface conductors are widely spaced. Referring to FIG. 4, a surface mount device is shown which has step configured leads 23 having first planar portions 24 connected to corresponding conductive sheets 12 and having second planar portions 26 connected to surface leads 21. This provides for connection to widely spaced conductors.

Figure 5:
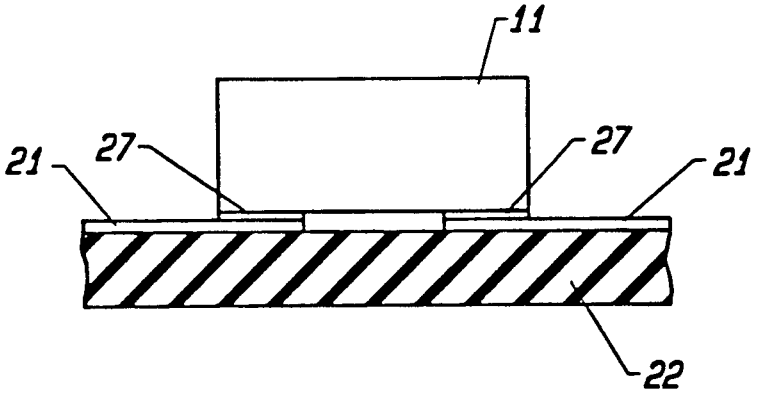
FIG. 5 is a side view of the overvoltage protection surface mount device with spaced apart side-by-side conductive planar sheets for attachment to spaced conductors.

In other instances, a horizontal configuration is desirable. Referring to FIG. 5, a surface mount device is shown in which the conductive sheets 27 are spaced apart for attachment to spaced surface leads 21. The quantum mechanical tunneling material is between the edges of the sheets adjacent the surface.

Regardless of the particular embodiment utilized, the invention operates in the same manner. A transient on conductive sheet 27 (or as the embodiment shown in FIGS. 1 through 4, conductive sheets 12) induces the composite material 11 to switch from a high-resistance state to a low-resistance state thereby largely clamping the voltage to a safe value and shunting excess electrical current from conductive sheet 27 through the composite material 11, which is ultimately connected to a system ground.

Electrically, binder 14 serves two roles: first it provides a media for tailoring separation between conductive particles 13, thereby controlling quantum mechanical tunneling; second, as an insulator it allows the electrical resistance of the homogenous dispersion to be tailored.

During normal operating conditions and within normal operating voltage ranges, with material 11 in the off-state, the resistance is quite high. Conduction is by conduction through the binder. Typically, it is either in the range required for bleed-off of electrostatic charge, ranging from one hundred thousand ohms to ten megaohms or more, or it is in a high resistance state in the 10 (to the 9th) ohm region.

Conduction in response to an overvoltage transient is primarily between closely adjacent conductive particles 13 and quantum mechanical tunneling through binder 14 separating the particles.

The electrical potential barrier for electron conduction between two particles is determined by the separation distance of spacing 16 and the electrical properties of the insulating binder material 14. In the off-state, this potential barrier is relatively high and results in a high electrical resistivity for the non-linear material. The specific value of the bulk resistivity can be tailored by adjusting the volume percent loading of the conductive particles 13 in the binder 14, their particle size and shape, and the composition of the binder itself. For a well-blended, homogenous system, the volume percent loading determines the inter-particle spacing.

Application of a high electrical voltage to the material 11 dramatically reduces the potential barrier to inter-particle conduction and results in greatly increased current flow through the material 11 via quantum-mechanical tunneling. This low electrical resistance state is referred to as the on-state of the non-linear material. The details of the tunneling process and the effects of increasing voltages on the potential barriers to conduction are described by the quantum-mechanical theory of matter at the atomic level, as is known in the art. Because the nature of the conduction is primarily quantum mechanical tunneling, the time response of the material to a fast rising voltage pulse is very quick. The transition from the off-state resistivity to the on-state resistivity takes place in the sub-nanosecond regime.

By way of example, if the resultant dimensions of the surface mount device are 0.100 inches wide by 0.100 inches long by 0.030 inches thick, a clamping voltage or knee of the I-V curve is in the range of 40 to 50 volts, an off-state resistance of ten mega-ohms at ten volts, and a clamp time less than one nanosecond may be achieved. Other clamping voltage specifications can be met by adjusting the thickness of the material formulation, or both.

An example of the material formulation, by weight, for the particular embodiment shown in FIGS. 2 and 3, is 35% polymer binder, 1% cross linking agent, and 64% conductive powder. In this formulation the binder is Silastic 35U silicon rubber, the crosslinking agent is dichlorobenzoyl peroxide, and the conductive powder is nickel powder with 10 micron average particle size. The table shows the electrical properties of a device made from this material formulation.

| | |
|---|---|
| Electrical Resistance in off-state (at 10 volts) | 10 (to the 7th) ohms |
| Electrical Resistance in on-state | 20 ohms |
| Response (turn-on) time | <5 nanoseconds |
| Capacitance | <5 pico-farads |

Those skilled in the art will understand that a wide range of polymer and other binders, conductive powders, formulations and materials are possible. Other conductive particles which can be blended with a binder to form the non-linear material in this invention include metal powders of aluminum, beryllium, iron, gold, silver, platinum, lead, tin, bronze, brass, copper, bismuth, cobalt, magnesium, molybdenum, palladium, tantalum, tungsten and alloys thereof, carbides including titanium carbide, boron carbide, tungsten carbide, and tantalum carbide, powders based on carbon including carbon black and graphite, as well as metal nitrides and metal borides.

The primary function of the binder 14 is to establish and maintain the inter-particle spacing 16 of the conducting particles 13 in order to ensure the proper quantum mechanical tunneling behavior during application of an electrical voltage. Accordingly, insulating binders can include but are not limited to organic polymers such as polyethylene, polypropylene, polyvinyl chloride, natural rubbers, urethanes, and epoxies, silicone rubbers, fluoropolymers, and polymer blends and alloys.

Other insulating binders include ceramics, refractory materials, waxes, oils, and glasses.

While substantially an insulator, the resistivity of binder 14 can be tailored by adding or mixing various materials which alter its electrical properties. Such materials include powdered varistors, organic semiconductors, coupling agents, and antistatic agents.

A wide range of formulations can be prepared following the above guidelines to provide clamping voltages from fifty volts to fifteen thousand volts. The interparticle spacing 16, determined by the particle size and volume percent loading, and the device thickness and geometry govern the final clamping voltage.

Figure 6:
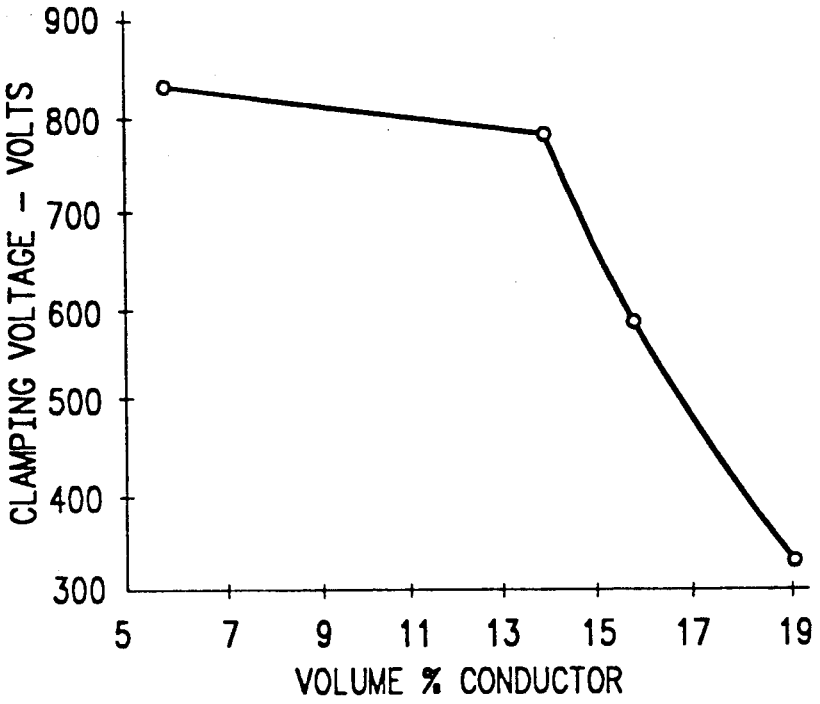
FIG. 6 is a graph of clamp voltage versus volume percent conductive particles for the overvoltage protection material of the present invention.

Referring to FIG. 6, depicted therein is Clamping Voltage as a function of Volume Percent Conductor for materials of the same thickness and geometry, and prepared by the same mixing techniques as heretofore described. The off-state resistance of the devices are all approximately ten mega-ohms. The on-state resistance of the devices are in the range of 10 to 20 ohms, depending upon the magnitude of the incoming voltage transient.

Figure 7:
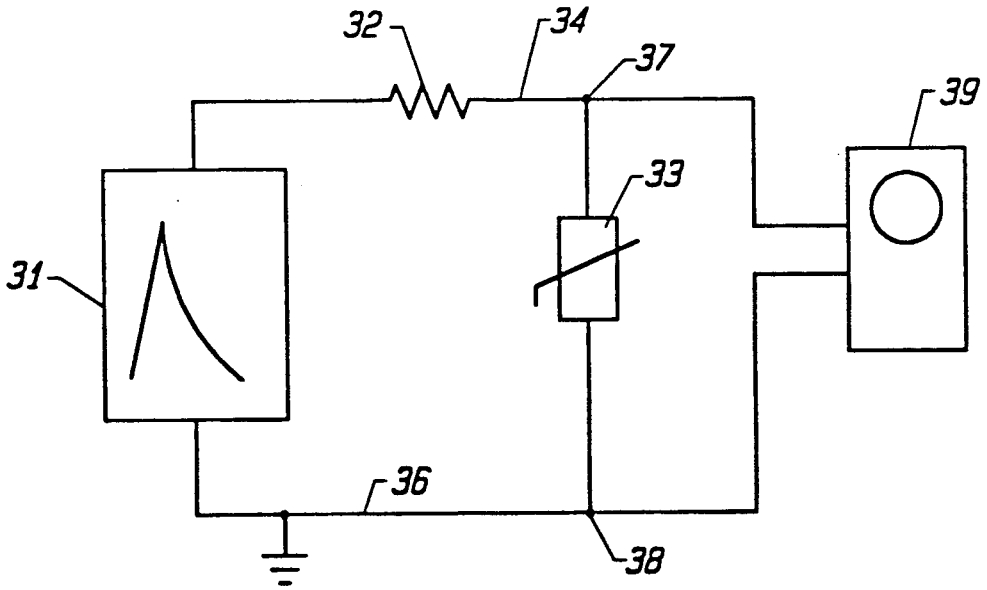
FIG. 7 is an example test circuit for measuring the overvoltage response of a simplified embodiment of the present invention.

FIG. 7 shows a test circuit for measuring the electrical response of a device made with materials of the present invention. A fast rise-time pulse, typically one to five nanoseconds, is produced by pulse generator 31. The output impedance 32 of the pulse generator is fifty ohms. The pulse is applied to the overvoltage protection apparatus 33 (any of those shown in FIGS. 3 through 5) which is connected between the high voltage line 34 and the system ground 36. The voltage versus time characteristics of the non-linear device are measured at points 37, 38 with a high speed storage oscilloscope 39.

Figure 8:
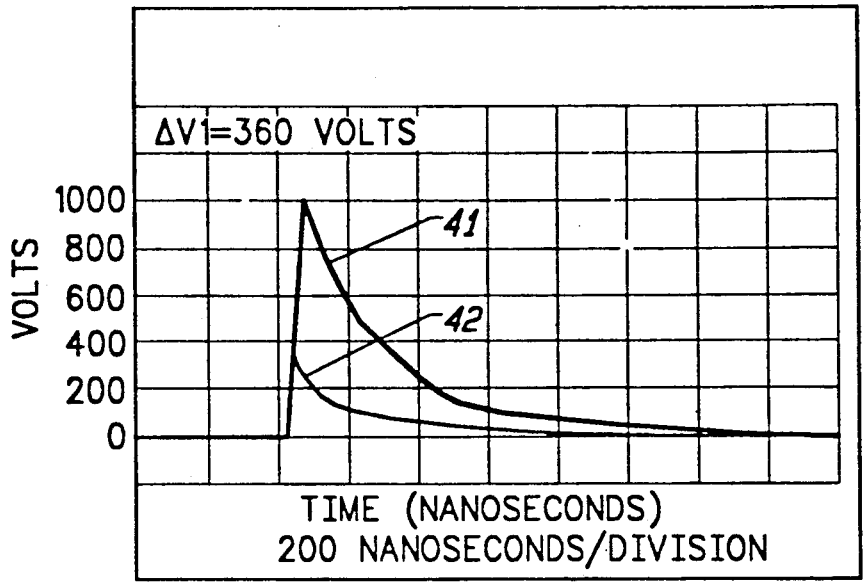
FIG. 8 is a graph of voltage versus time for a transient overvoltage pulse applied to a simplified embodiment of the present invention.

Referring now to FIG. 8, the typical electrical response of apparatus 33 tested in FIG. 7 is depicted as a graph of voltage versus time for a transient overvoltage pulse applied to the apparatus 33. In the figure, the input pulse 41 has a rise time of five nanoseconds and a voltage amplitude of one thousand volts. The device response 42 shows a clamping voltage of 360 volts in this particular example. The off-state resistance of the apparatus 33 tested in FIG. 7 is eight mega-ohms. The on-state resistance in its non-linear resistance region is approximately 20 ohms to 30 ohms.

Figure 9:
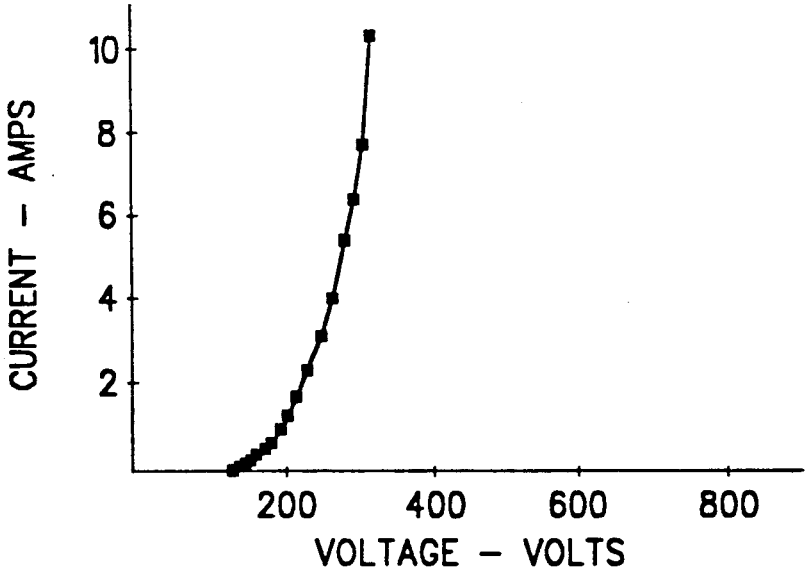
FIG. 9 is a graph of current versus voltage for a simplified embodiment of the present invention.

FIG. 9 depicts the current-voltage characteristics of a device made from the present invention. The highly non-linear nature of the material used in the invention is readily apparent from the figure. Specifically, below the threshold voltage Vc the resistance is constant, or ohmic, and very high, typically 10 mega-ohms for applications requiring static bleed, and 10(to the 9th) ohms or more for applications which do not require static bleed. On the other hand, above the threshold voltage Vc the resistance is extremely voltage dependent, or non-linear, and can be as low as approximately 10 ohms to 30 ohms for devices made from the present invention.

The process for fabricating the material of the present invention includes standard polymer processing techniques and equipment. A preferred process uses a two roll rubber mill for incorporating the conductive particles into the binder material. The polymer material is banded on the mill, the crosslinking agent (if required) is added, and then the conductive particles are added slowly to the binder. After complete mixing of the conductive particles into the binder, it is sheeted off the mill rolls. Other polymer processing techniques can be used including Banbury mixing, extruder mixing and other similar mixing equipment.

Thus, it is apparent that there has been provided, in accordance with the invention, an overvoltage protection device that fully satisfies the objects, aims and advantages set forth above. While the invention has been described in conjunction with specific embodiments thereof, it is evident that many alternatives, modifications, and variations will be apparent to those skilled in the art in light of the foregoing description.

We claim:

1. A transient overvoltage protection surface mount device for mounting between spaced flat conductors carried by an insulating substrate for protecting against electrical overvoltage transients between said conductors comprising:

spaced apart conductive sheets which face each other;

a quantum mechanical tunneling material disposed between said pair of spaced conductive sheets serving to link said pair of conductive sheets by quantum mechanical tunneling when said voltage between sad conductive plates exceeds a predetermined voltage; and means for connecting each of said sheets to an associated spaced conductor wherein said connecting means comprises L-shaped leads having first and second planar portions at right angles to one another, said first planar portions connected to said spaced apart sheets and said second planar portions connected to said associated spaced conductors.

2. A transient overvoltage protection surface mount device for mounting between spaced flat conductors carried by an insulating substrate for protecting against electrical overvoltage transients between said conductors comprising:

spaced apart conductive sheets;

a quantum mechanical tunneling material disposed between said pair of spaced conductive sheets serving to link said pair of conductive sheets by quantum mechanical tunneling when said voltage between said conductive plates exceeds a predetermined voltage;

means for connecting each of said sheets to an associated spaced conductor; and wherein said tunneling material is a matrix formed of only closely spaced homogeneously distributed, conductive particles, said particles being in the range of 10 microns to two hundred microns and spaced in the range of 25 angstroms to provide said quantum mechanical tunneling therebetween; and a binder selected to provide a quantum mechanical tunneling media and predetermined resistance between said conductive particles.

3. A transient overvoltage protection surface mount device as recited in claim 2, wherein:

said spaced sheets face one another; and said connecting means comprises L-shaped leads having first and second planar portions at right angles to one another, said first planar portions connected to said spaced sheets and said second planar portions connected to said associated spaced conductors.

4. A transient overvoltage protection surface mount device as recited in claim 3, further comprising:

means for connecting each one of said first planar portions to a corresponding one of said pair of conductive sheets; and means for connecting each one of said second planar portions to an associated flat conductor.

5. A transient overvoltage protection surface mount device for mounting between spaced flat conductors carried by an insulating substrate for protecting against electrical overvoltage transients between said conductors comprising:

spaced apart conductive sheets;

a quantum mechanical tunneling material disposed between said pair of spaced conductive sheets serving to link said pair of conductive sheets by quantum mechanical tunneling when said voltage between said conductive plates exceeds a predetermined voltage;

means for connecting each of said sheets to an associated spaced conductor;

wherein said spaced sheets face one another; and wherein said connecting means comprises a lead having incremental planar portions at right angles to one another in a step configuration, the first and second planar end portions being perpendicular to one another.

6. A transient overvoltage protection surface mount device as recited in claim 5, further comprising:

means for connecting each one of said first planar end portions to a corresponding one of said pair of conductive sheets; and means for connecting each one of said second planar end portions to an associated flat conductor.

7. A transient overvoltage protection surface mount device for mounting between spaced flat conductors carried by an insulating substrate for protecting against electrical overvoltage transients between said conductors comprising:

spaced apart conductive sheets which face each other;

a quantum mechanical tunneling material disposed between said pair of spaced conductive sheets serving to link said pair of conductive sheets by quantum mechanical tunneling when said voltage between said conductive plates exceeds a predetermined voltage;

means for connecting each of said sheets to an associated spaced conductor;

wherein said pair of spaced apart conductive sheets are side-by-side;

wherein said pair of spaced apart conductive sheets lie in the same plane; and wherein said spaced apart conductive sheets are disposed on the same surface of said quantum mechanical tunneling material.

8. A transient overvoltage protection surface mount device as recited in claim 7, further comprising:

means for connecting each one of said pair of conductive sheets to locations at opposite ends of said quantum mechanical tunneling material; and means for connecting each one of said pair of conductive sheets' opposite surface to an associated flat conductor.

9. The device of claim 1 wherein said tunneling material is a matrix formed of only closely spaced homogeneously distributed, conductive particles, said particles being in the range of 10 microns to two hundred microns and spaced in the range of 25 angstroms to provide said quantum mechanical tunneling therebetween; and a binder selected to provide a quantum mechanical tunneling media and predetermined resistance between said conductive particles.

10. The device of claim 5 wherein said tunneling material is a matrix formed of only closely spaced homogeneously distributed, conductive particles, said particles being in the range of 10 microns to two hundred microns and spaced in the range of 25 angstroms to provide said quantum mechanical tunneling therebetween; and a binder selected to provide a quantum mechanical tunneling media and predetermined resistance between said conductive particles.

11. The device of claim 7 wherein said tunneling material is a matrix formed of only closely spaced homogeneously distributed, conductive particles, said particles being in the range of 10 microns to two hundred microns and spaced in the range of 25 angstroms to provide said quantum mechanical tunneling therebetween; and a binder selected to provide a quantum mechanical tunneling media and predetermined resistance between said conductive particles.

* * * * *